US006200090B1

(12) United States Patent
Chien et al.

(10) Patent No.: US 6,200,090 B1
(45) Date of Patent: Mar. 13, 2001

(54) PUMP CASING FOR SHEET METAL PUMP

(75) Inventors: Huan-Jan Chien; Kuo-Yu Tang; Ming-Chuan Shih; Charlie Pen, all of Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/289,587

(22) Filed: Apr. 12, 1999

(51) Int. Cl.[7] ..... F04D 29/44

(52) U.S. Cl. ..... 415/172.1; 415/200; 415/204; 415/206; 415/214.1; 415/915

(58) Field of Search ..... 415/203, 204, 415/206, 200, 214.1, 215.1, 213.1, 915, 172.1

(56) References Cited

U.S. PATENT DOCUMENTS 5,069,599 * 12/1991 Carretta ..... 415/182.1
5,112,190 * 5/1992 Kajiwara et al. ..... 415/215.1
5,358,380 * 10/1994 Arakawa ..... 415/200
5,385,444 * 1/1995 Kobayashi et al. ..... 415/182.1

* cited by examiner

*Primary Examiner*—Edward K. Look
*Assistant Examiner*—Ninh Nguyen
(74) *Attorney, Agent, or Firm*—Dougherty & Troxell

(57) ABSTRACT

An pump casing for a sheet metal pump includes a pump body made by pressing or roll forming a sheet metal, a reinforced member which includes a water guide unit and a flange unit separately made by casting or CNC machining and a seal ring engaged with the water guide unit. The pump body is a simple basin shape which can be produced with less stress concentration. The water guide unit may be made with a more precise volute for achieving better pumping efficiency. The reinforced member may increase structural strength of the pump casing for withstanding greater pumping pressure and external forces. The seal ring may be positioned precisely without dislocation because it engages with the water guide unit rather than the pump casing. The gap between the seal ring and the impeller may be kept small and constant, thus obtaining better pumping efficiency, lower operation noise and greater durability.

14 Claims, 7 Drawing Sheets

PUMP CASING FOR SHEET METAL PUMP

BACKGROUND OF THE INVENTION

1. Field of the Invention

This invention relates to an improved pump casing for a sheet metal pump and particularly to a pump casing that includes a sheet metal pump body with a reinforced member which has a guide water unit made by casting or injection molding.

2. Description of the Prior Art

Conventional centrifugal pumps are generally made by casting or pressing of sheet metals. The casting method uses cast iron as material which has low stiffness, poor corrosion resistance, and is heavy weight and bulky. It generally has poor durability. It is therefore mainly used for low price pumps. Sheet metal pump made by pressing may have greater mechanical strength, better corrosion resistance such as those made of stainless steel and is light weight and more durable. However sheet meal pump generally has thin casing which is prone to deform under heavy external forces.

It is generally known that the inlet and outlet of the pump casing connecting with outside piping system have to endure great stress resulting from pumping pressure, impeller induced torque and stress, metal strain and stress caused by temperature change and the like. As a result, the pump casing around the inlet and outlet are most likely to deform under pressure. That may cause impeller vibration at high speed and produce excessive friction and noise. To remedy this problem, a number of improvements have been introduced. European Pat. No. EXPO-00442070A1 (Ghiotto) and U.S. Pat. No. 5,310,310 are two of the examples. As shown in FIG. 1, the Ghiotto disclosed a sheet metal pump casing 21 which has a seal ring 23 (or wear ring as also may be called) engaged with the pump casing 21 near the inlet end plate 26 adjacent the inlet 22 located at a front end 25 of the impeller 24 of the centrifugal pump 20.

The seal ring 23 keeps a small gap between the front end of the impeller 24 and the inside wall of the pump casing 21 so that friction may become lower when the impeller 24 rotates at high speed while still having desirable pumping performance. The gap set forth above directly affects pumping efficiency, noise level and durability. Conventional pump has the seal ring fixing to the inlet end plate adjacent the inlet where the deformation is most likely to take place because of the causes given above. Such deformation will cause position shifting of the seal ring and result in greater friction and noise, dropping of pumping efficiency, and shorter durability. Furthermore, the structural strength of conventional sheet metal pumps is general not very strong and consequently reduces its thermo stress strength. Hence the sheet metal pumps made by conventional technique usually work mainly in environments under 150° C.

Moreover, sheet metal pumps made by conventional technique is done by pressing. It is a complex and multiple stages pressing or stamping process to form the tapering cross-section of the volute for containing the impeller. U.S. Pat. No. 5,310,310 discloses a technique that uses multi-stage pressing operations for such purpose. It needs a plurality of different molds. Its production time is longer and the cost is higher. The pressing or stamping operation also tends to produce metal stress concentration that might weaken the mechanical strength of the pump casing.

Conventional metal pump structure also is mostly focused on the reinforcement of the pump casing at the inlet. The pump casing engaging with the motor has often being overlooked. The issues of mechanical strength noise problem and durability at this portion has rarely being addressed. Some may put a back cover 27 (shown in FIG. 1) as a supporting means for the pump casing and the motor. It usually does not have strong enough mechanical strength and may produce heavy vibration at high-speed and great noise and results in poor durability as well.

SUMMARY OF THE INVENTION

In view of aforesaid problems and disadvantages, it is therefore an object of this invention to provide an improved metal sheet pump that has a pump casing of greater mechanical strength, lower noise level, better shaped volute and greater durability.

It is another object of this invention to provide an improved metal sheep pump casing that has a separately made water guide unit engaging with a seal ring so that the seal ring may be positioned more precisely and maintain precise gap with the impeller even under pump casing deformation for obtaining lower noise, better efficiency and greater durability.

It is a further object of this invention to provide an improved metal sheet pump casing that has a reinforced structure for the engagement of the pump casing and the motor.

It is yet another object of this invention to provide an improved sheet metal pump casing that has an independent water guide unit which may be made separately from the pump casing so that the pump casing may be produced easily with less stress concentration. The water guide unit may also be produced more precisely by means of 3D machining for enhancing pumping efficiency.

A preferred embodiment of the sheet metal pump casing according to this invention includes a pump body made by pressing or roll forming a sheet metal. The pump body has a basin shape with an inlet end plate at one side and an annular motor end plate at another side. The inlet end plate has an inlet while the motor end plate has an outlet. There is an independent reinforced member made by casting or CNC (computer numerical control) machining. The reinforced member has an annular shape to be housed within the pump body and includes a water guide unit and a flange unit. The water guide unit has a volute formed therein to house an impeller. The flange unit has a plurality of screw bores formed in a lateral side opposite to the inlet. A seal ring is engaged with the reinforced member at the inlet side and has an inner circumference adjacent the impeller around the inlet. The water guide unit and the flange unit may be produced separately and then be assembled together by means of soldering, riveting, adhering, screwing, latching or other mans known in the art. The flange unit may have a wall of cut away openings (or areas) to reduce weight. The water guide unit may be made of plastics through injection molding process and may engage with the seal ring in the injection molding process.

According to one aspect of this invention, the seal ring and the water guide unit may be integrally formed to get greater strength. A dividing ring may be provided and attached to the inlet end plate, and has an annular flange extending toward the impeller adjacent the seal ring for reducing pressure difference between two sides of the seal ring so that the seal ring may be positioned more precisely and has less deformation under pumping pressure. This helps for enhancing pumping efficiency, lowering noise and greater durability.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

Figure 1:
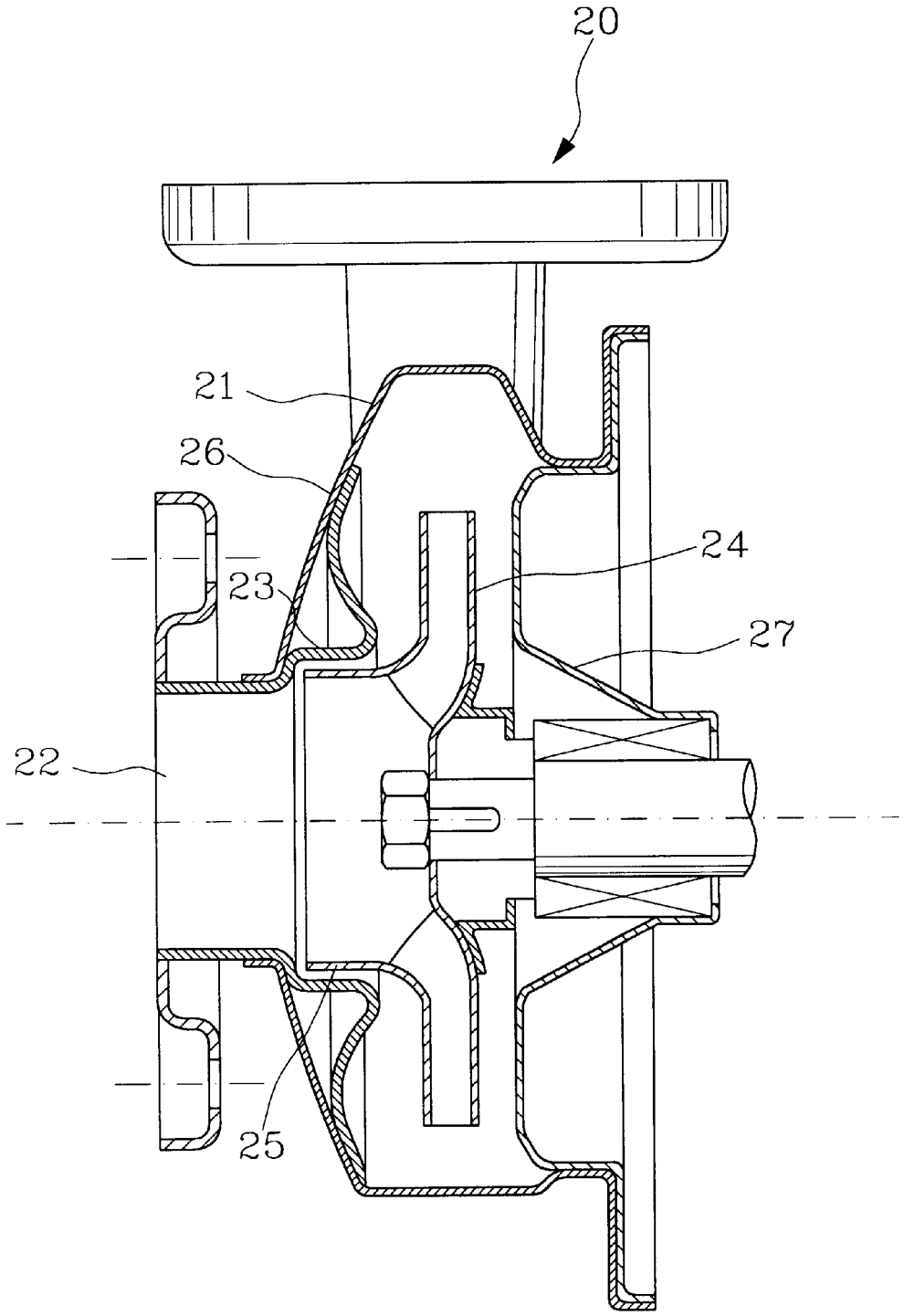
FIG. 1 (PRIOR ART)
FIG. 1 is a sectional view of a conventional sheet metal pump casing.

The main design principle of this invention is to produce the pump volute and other major components separately, and then to assemble them together. By means of this technique, the production process may become simpler, more precise, and the pump casing may have greater mechanical strength. The seal ring engages with pump volute rather than with the pump casing as conventional one does. This may reduce stress concentration after sheet metal forming of the pump casing. The introduction of an independent reinforced member and repositioning of the seal ring enables this invention to withstand greater external and pumping pressure without significant deformation even at high temperature working environment such like 150~200° C. or even higher. Pumping efficiency may be increased, noise level is lower and durability is enhanced. More efficient production technique such as 3D machining is also become possible or easier to use.

Referring to FIGS. 2 through 5, the sheet metal pump casing 30 according to an embodiment of this invention is for a centrifugal pump which has an impeller 41 housed in the pump casing and driven by a motor 42. The pump casing 30 includes a pump body 31, a reinforced member 32 and a seal ring 33.

The pump body 31 is a basin shape member made by pressing or roll forming a sheet metal. It includes an inlet end plate 311 as the basin bottom with an inlet 313 formed in the center and a motor end plate 312 in the form of an annular rim. The inlet 313 engages with an inlet flange 43. The motor end plate 312 has an outlet (not shown in the figures) engaging with an outlet flange 44. The pump body 31 is a simple basin shape and thus may be formed by pressing or roll forming with less stress concentration than conventional one which has more complicated form. The mechanical strength of the pump body 31 is thus stronger and costs less than the conventional one which needs multiple molds to produce under multiple pressing or stamping processes.

The reinforced member 32 is annular shaped and a separated member from the pump body 31. The reinforced member 32 is fixed to the inside wall of the pump body 31 by means of soldering, riveting adhering, screwing, latching or other means known in the art. The reinforced member 32 includes a water guide unit 321 and a flange unit 322 which are separately made of different or same type of material. The water guide unit 321 and flange unit 322 are then engaged with each other by means of soldering, riveting, adhering, screwing, latching or other means known in the art. In another aspect of this invention, the water guide unit 321 and the flange unit 322 may also be integrally formed together to become a single piece reinforced member 32.

In a preferred embodiment of this invention, the water guide unit 321 and the flange unit 322 may be made by casting, 3D CNC machining or injection molding. Within the water guide unit 321, a taper crosssection volute 3211 is formed to house the impeller 41 for pumping use. As the water guide unit 321 may be made by 3D CNC machining, the volute 3211 may be formed precisely to achieve better pumping efficiency and overcome the machining difficulty encountered by conventional sheet metal pump production.

The flange unit 322 is also an annular member with a plurality of screw bores 3211 located in a lateral side opposite to the inlet 313 for engaging with a motor bracket 46 which becomes the mounting interface of the pump casing 30 to the motor 42. The flange unit 322 greatly enhances the structural supporting strength of the pump casing for the motor and makes the whole pump assembly strong and reliable.

In the preferred embodiment, the seal ring 33 is also being separately made and then engages with the reinforced member 32 on the water guide unit 321 and around the inlet 313 by means of soldering, wedging, adhering, screwing, riveting, latching or other means known in the art. The inner circumference of the seal ring 33 is adjacent the impeller 41 at the inlet 313 side. In another embodiment which is not shown in the figures, the water guide unit 321 may be made of plastics by means of injection molding process and the seal ring 33 may be integrally formed with the water guide unit 321 during the injection process by engaging an outer circumference of the seal ring 33 with the water guide unit 321.

Since the seal ring 33 is fixed to the water guide unit 321 rather than to the pump casing as the conventional one does, when the inlet end plate 311 deforms because of pumping pressure change, impeller torque variation, piping pressure change or thermo stress resulting from temperature difference, the position of the seal ring 33 will not be affected. The gap between the seal ring 33 and the impeller 41 at the inlet 313 may be maintained at a constant value. This helps to maintain high pumping efficiency, low vibration and noise and long durability.

Of course this invention may also adopt a conventional technique by installing a wear ring (not being numbered in the figures) between the impeller 41 and the motor 42, and by adding a back cover (also not being numbered in the figures) to seal the pumping case 30 at the motor side to prevent pumping liquid from leaking. This technique is known in the art and forms not part of this invention and thus is omitted here.

The following shows other preferred embodiments of this invention. Like components as the ones shown in the preferred embodiments set forth above will be marked by like numerals except affixing with an 'a' or 'b'.

Figure 6:
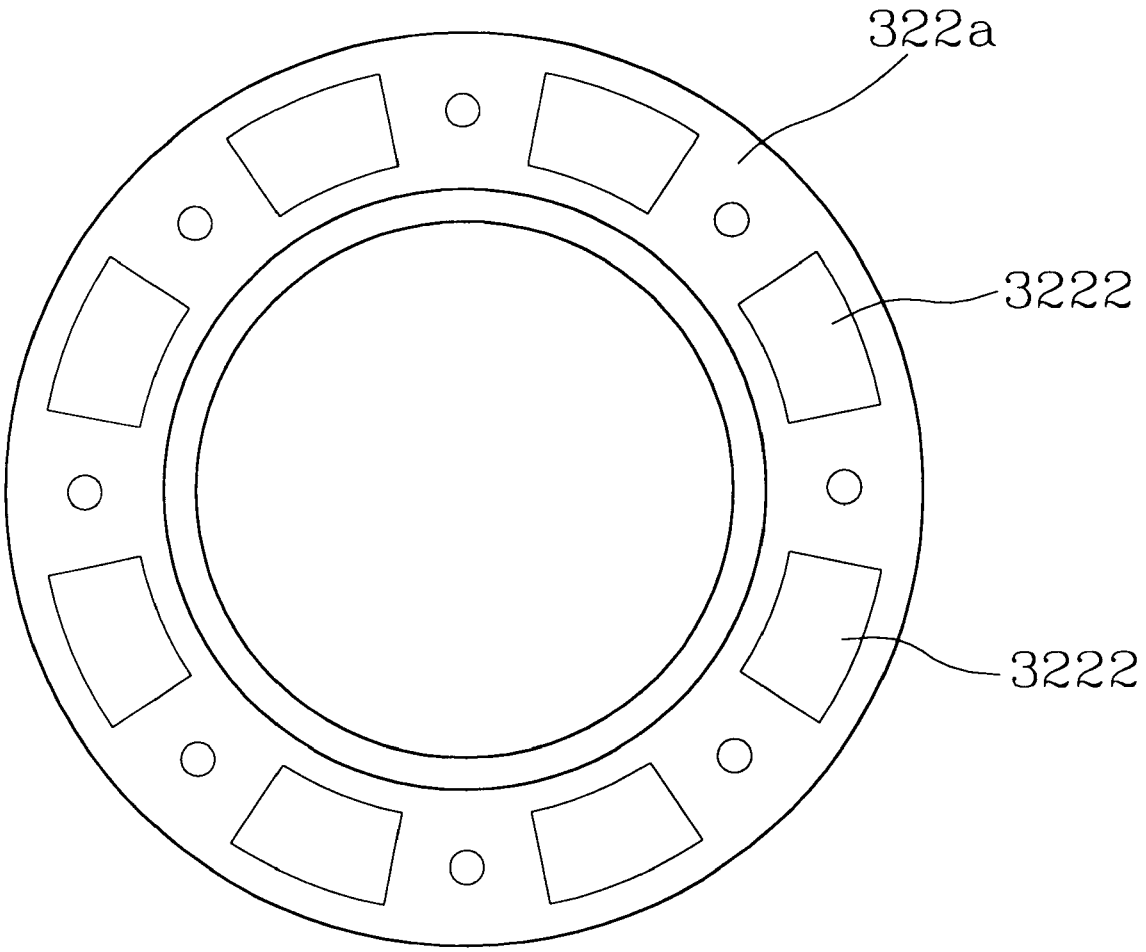
FIG. 6 is a front view of another embodiment of a flange unit.

FIG. 6 illustrates another embodiment of a flange unit 322*a*. A plurality of cut openings (or areas) 3222 are formed therein to reduce total weight.

Figure 2:
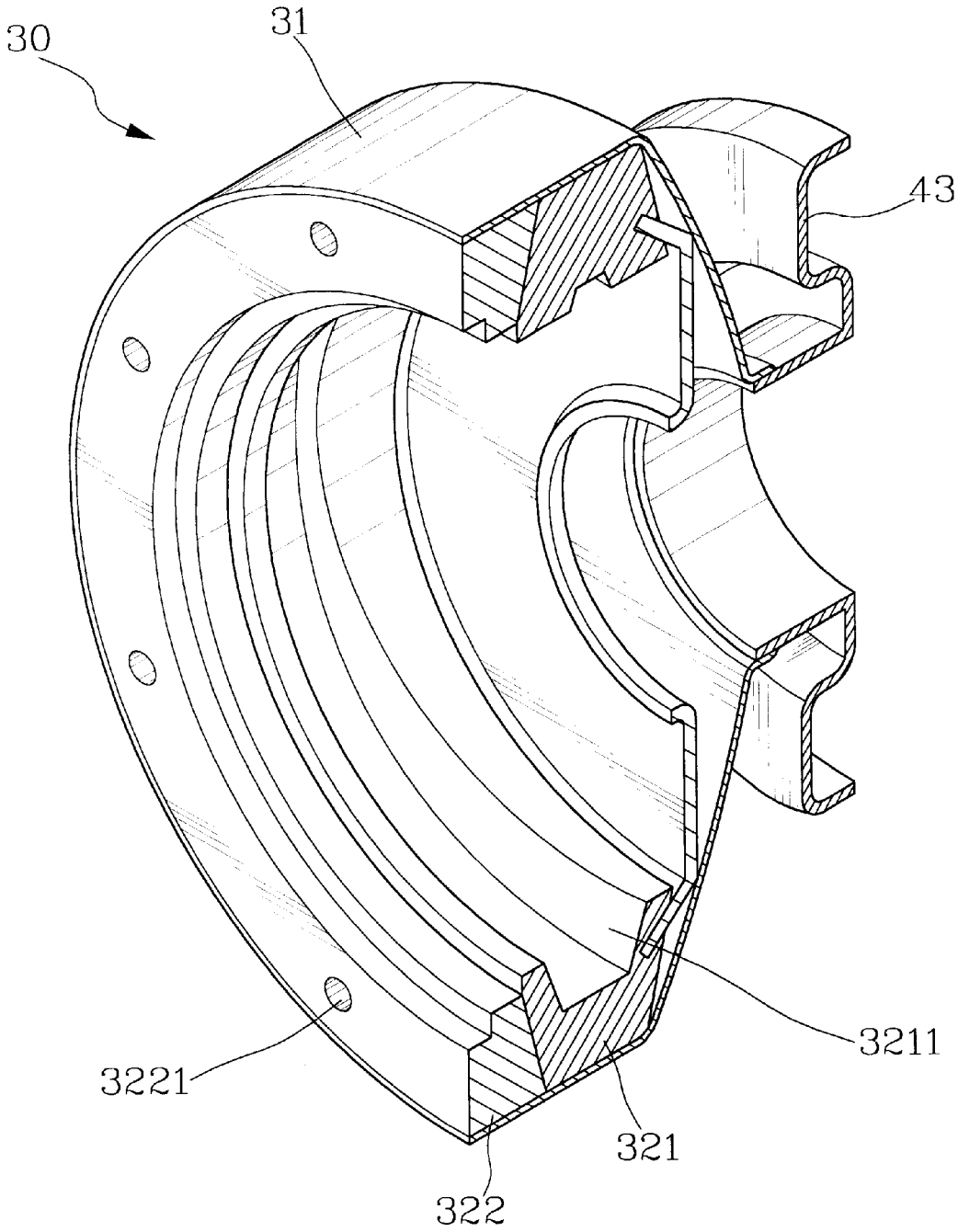
FIG. 2 is a perspective sectional view of this invention.
Figure 3:
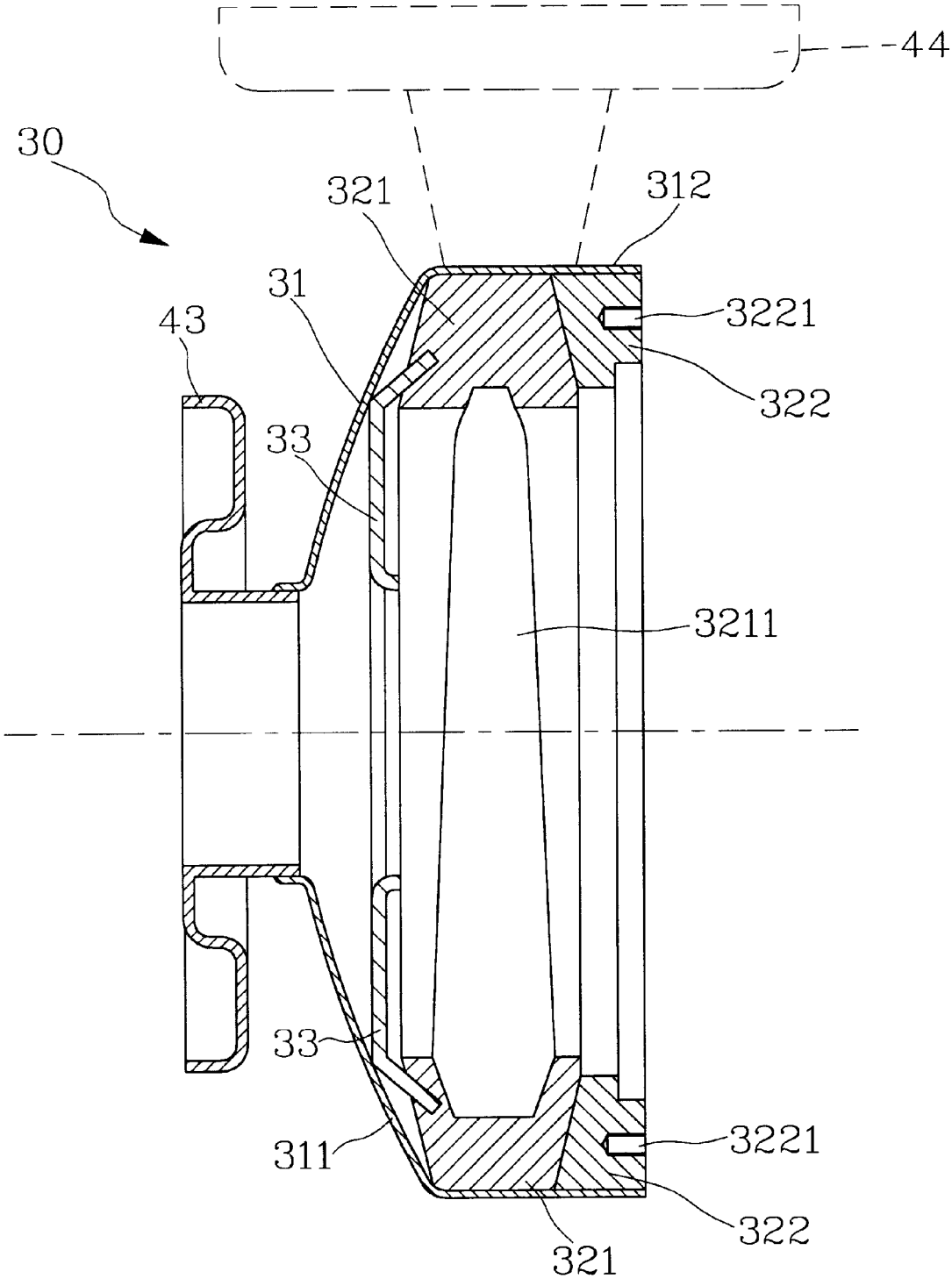
FIG. 3 is a sectional view of this invention.
Figure 4:
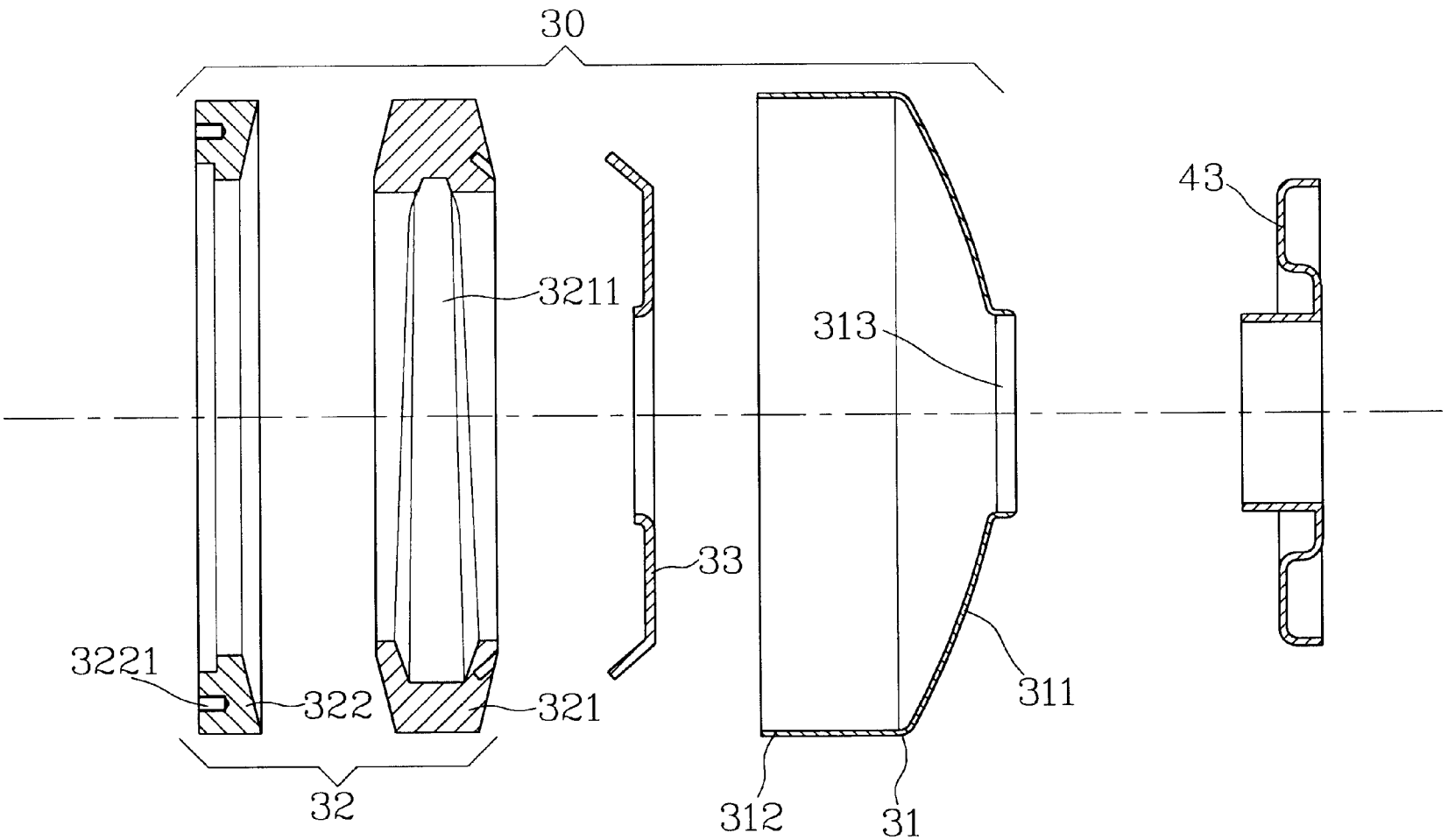
FIG. 4 is an exploded view of the embodiment shown in FIG. 3.
Figure 5:
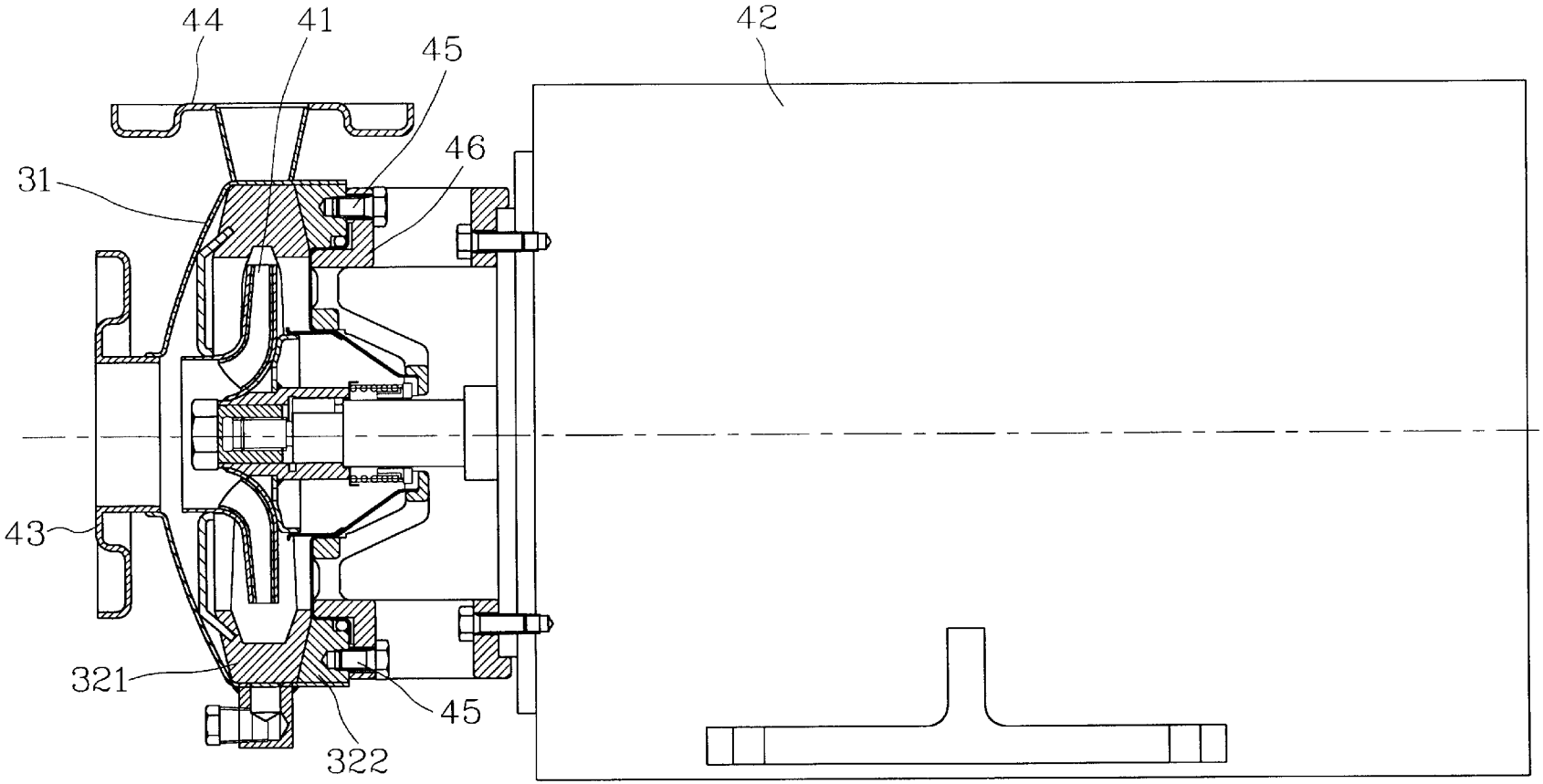
FIG. 5 is a sectional view of this invention in use, assembled with an impeller and a motor.
Figure 7:
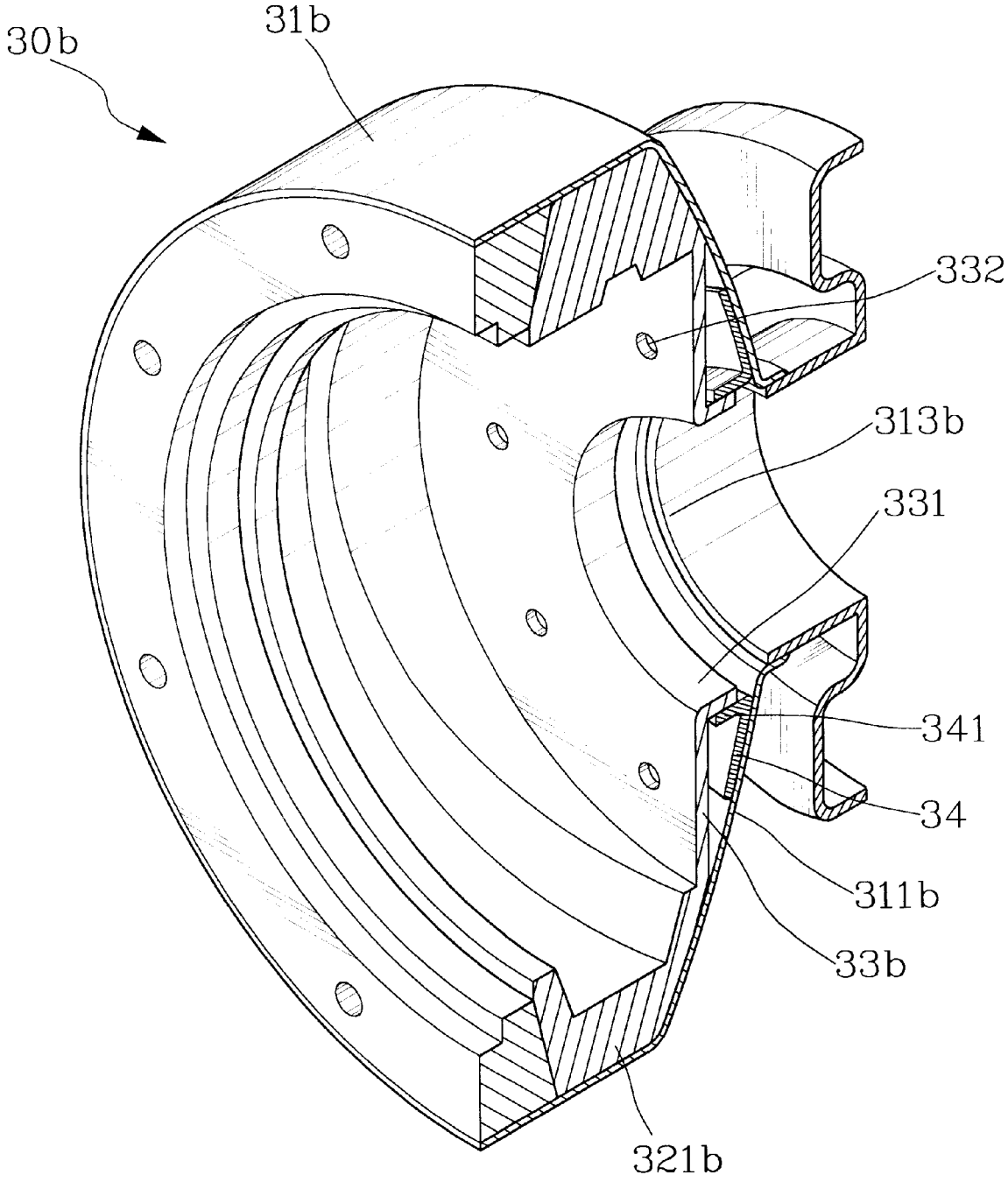
FIG. 7 is a perspective sectional view of another embodiment of this invention.

FIG. 7 show yet another embodiment of the pump casing 30*b* which is largely constructed like the one shown in FIG. 2. However the seal ring 33*b* is integrally formed with the water guide unit 321*b* for enhancing their engagement. Furthermore the seal ring 33*b* has an annular neck 331 extending toward the inlet 313*b*. A dividing ring 34 is provided and fixed to the inlet end plate 311*b* around the inlet 313*b*. The dividing ring 34 has an annular flange 341 overlapping with the neck 331 with a small gap between them. The seal ring 33*b* also has a plural number of through holes (or through areas) 332. This design allows reducing the pressure difference between the two opposite sides of the seal ring 33*b*. The dividing ring 34 may also move axially slightly and serves as a buffer for the seal ring 33*b* when the inlet end plate 311*b* subjects to external pressure change so that the seal ring 33*b* may be maintained at its position precisely. This further helps to enhance pumping efficiency, reduce noise and improve durability.

In summary, this invention provides an improved pump casing for sheet metal pump that has lower stress concentration, greater structural strength, better pumping efficiency, greater capability to operate at high temperature such as above 150° C., lower noise and greater durability.

It may thus be seen that the objects of the present invention set forth herein, as well as those made apparent from the foregoing description, are efficiency attained. While the preferred embodiments of the invention have been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. An improved pump casing for centrifugal sheet metal pump which includes a motor, and a motor driven impeller for pumping liquid, said pump casing comprising:

a pump body formed in a basin shape including an inlet end plate which has an inlet formed therein and an annular motor end plate which has an outlet formed therein;

a reinforced member separately made from the pump body and engageable with an inside wall of the motor end plate having an annular circumference, a water guide unit which includes a volute for housing the impeller and a flange unit having a plurality of screw bores in a lateral side opposite to the inlet; and a seal ring engageable with the reinforced member at an inlet side of the water guide unit having an inner circumference adjacent the impeller around the inlet, wherein the water guide unit and the flange unit are integrally made by a manufacturing method chosen from a group consisting of casting, CNC machining, and injection molding.

2. The pump casing of claim 1, wherein the basin-shaped pump body is made by a manufacturing method chosen from a group consisting of pressing a sheet metal and roll forming a sheet metal.

3. The pump casing of claim 1, wherein the flange unit has a plurality of stepped cut off areas for reducing weight.

4. The pump casing of claim 1, wherein the seal ring is engaged with the reinforced member by a method chosen from a group consisting of soldering, adhering, wedging, screwing, riveting, latching and friction bonding.

5. The pump casing of claim 1, wherein the water guide unit is made of plastic by means of an injection molding process, and wherein the seal ring is engaged with the water guide unit through the injection molding process.

6. The pump casing of claim 1 further including a motor bracket located between the pump body and the motor and being engaged with the reinforced member and pump body.

7. The pump casing of claim 1 further including a dividing ring fixed to the inlet end plate adjacent the inlet, the dividing ring having an annular flange extending toward the impeller and forming a close gap with an inner circumference of the seal ring.

8. A pump casing for a sheet metal pump, said sheet metal pump comprising: a motor, an impeller housed in the pump casing and driven by the motor, and a motor bracket fixedly engaging with the pump casing at one side thereof and the motor at another side thereof; improvements of said pump casing comprising:

said pump casing including a pump body, a reinforced member and a seal ring that are being separately made and assembled together, the pump body being formed in a basin shape and having an inlet end plate remote from the motor bracket and an annular motor end plate; the reinforced member being housed in the pump body and having a water guide unit adjacent the inlet end plate and a flange unit adjacent the motor bracket, the water guide unit having a volute formed therein for housing the impeller; the seal ring being engaged with the water guide unit adjacent the inlet end plate and having an inner circumference adjacent the impeller around the inlet end plate; the flange unit having one side engaged with the pump body and another side thereof engaged with motor bracket, wherein the water guide unit and the flange unit are integrally made by a manufacturing method chosen from a group consisting of casting, CNC machining, and injection molding.

9. The pump casing of claim 8, wherein the basin-shaped pump body is made by a manufacturing method chosen from a group consisting of pressing a sheet metal and roll forming a sheet metal.

10. The pump casing of claim 8, wherein the flange unit has a plurality of stepped cut off areas for reducing weight.

11. The pump casing of claim 8, wherein the seal ring is engaged with the reinforced member by a method chosen from a group consisting of soldering, adhering, wedging, screwing, riveting, latching and friction bolding.

12. The pump casing of claim 8, wherein the water guide unit is made of plastic by means of an injection molding process, and wherein the seal ring is engaged with the water guide unit through the injection molding process.

13. The pump casing of claim 8, wherein the motor bracket engages with the flange unit and the pump body by means of screwing.

14. The pumping casing of claim 8 further including a dividing ring fixed to the inlet end plate adjacent the inlet, the dividing ring having an annular flange extending toward the impeller and forming a close gap with an inner circumference of the seal ring, the seal ring further having a plurality of through holes formed therein.

* * * * *